United States Patent [19]

DeSantis

[11] 4,047,864

[45] Sept. 13, 1977

[54] APPARATUS FOR PRODUCING SPHERICAL ARTICLES

[75] Inventor: Raymond P. DeSantis, Royal Oak, Mich.

[73] Assignee: Wolverine Aluminum Corporation, Lincoln Park, Mich.

[21] Appl. No.: 619,855

[22] Filed: Oct. 6, 1975

[51] Int. Cl.[2] ..... B30B 11/02

[52] U.S. Cl. ..... 425/78; 425/408; 425/410; 425/416

[58] Field of Search ..... 425/78, 116, 408, DIG. 44, 425/DIG. 35, 410, 416

[56] References Cited

U.S. PATENT DOCUMENTS

| | | | |
|---|---|---|---|
| 1,684,984 | 9/1928 | Claus | 425/DIG. 35 |
| 1,979,156 | 10/1934 | Hettel | 425/DIG. 35 |
| 2,893,062 | 7/1959 | Penrice | 425/DIG. 44 |
| 3,255,279 | 6/1966 | Smith | 425/408 |
| 3,452,121 | 6/1969 | Cochardt et al. | 425/416 X |
| 3,775,032 | 11/1973 | Smith et al. | 425/78 |

*Primary Examiner*—J. Howard Flint, Jr.

*Attorney, Agent, or Firm*—Hauke & Patalidis

[57] ABSTRACT

An apparatus for compressing powder material into at least partially spherical articles, comprising a die and upper and lower reciprocally movable punches. The die has a center bore through which the lower punch is reciprocable. The wall at the upper part of the die bore is enlarged to form a spherical zone portion of a hemispherical cavity. The end face of the lower punch has a concave shape to form a segment of the hemispherical cavity when the face of the lower punch is flush with the die cavity wall. The lower face of the upper punch defines a hemispherical cavity which mates with the hemispherical cavity of the die. In operation, the bore and die cavity are charged with powder material and the upper punch is brought into engagement with the die. A compaction stroke by the lower punch then forces the powder material into the spherical cavity. The upper punch is then withdrawn and the compacted spherical article is removed from the die. Alternatively, the end face of the lower punch may be flat, convex, or any other appropriate shape to compact partially spherical articles.

6 Claims, 11 Drawing Figures

Fig-1
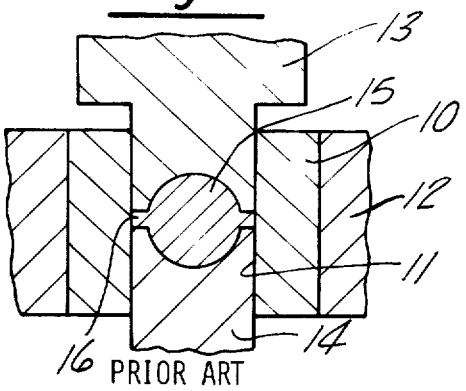
Fig-2
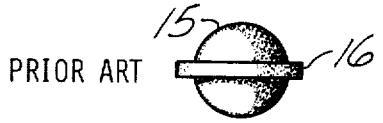
Fig-5
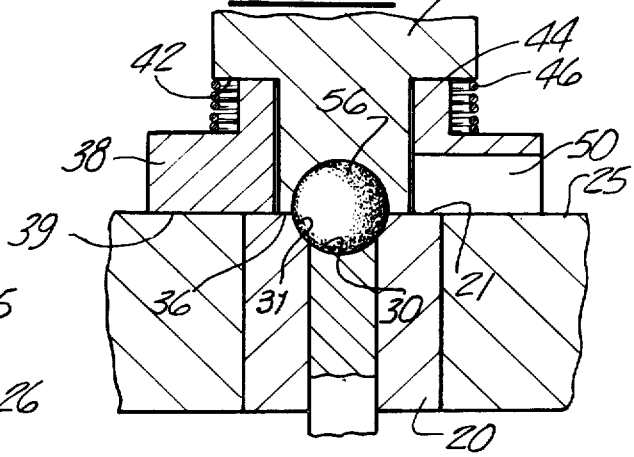
Fig-3
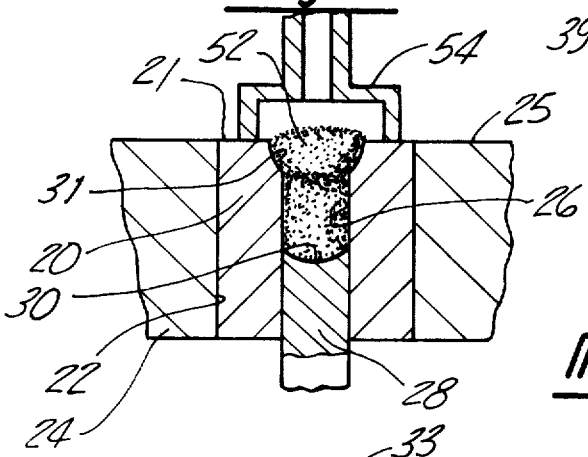
Fig-6
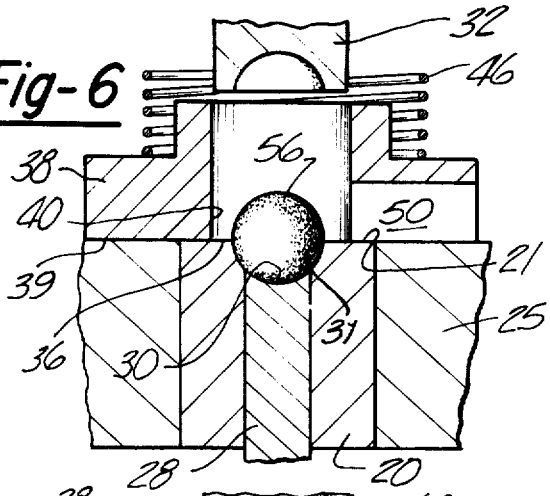
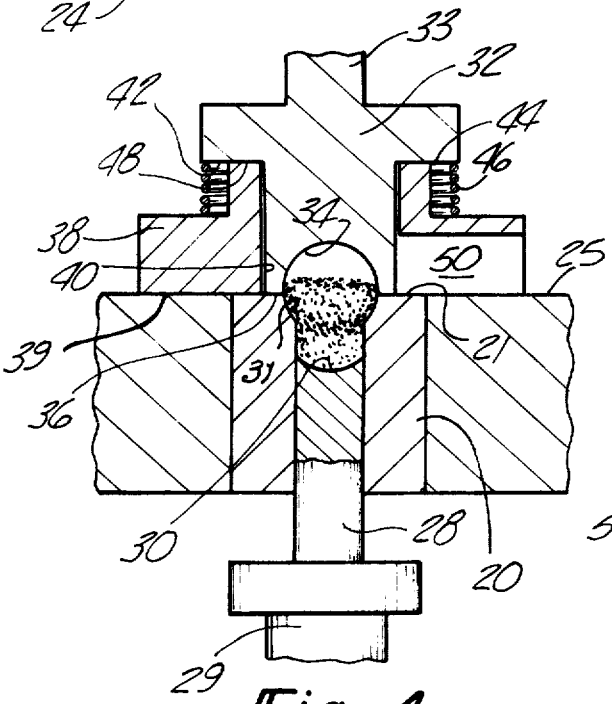
Fig-4
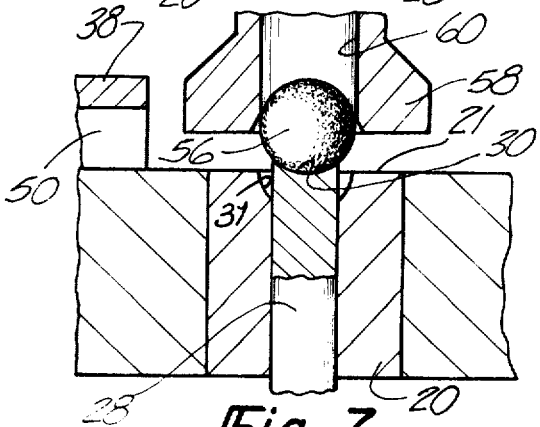
Fig-7

66
62
64
60
56
30
58
25
28
78
33
72
74
76
70
68
32
46
25
12
56'
80
20
28
56"
82
20
28

APPARATUS FOR PRODUCING SPHERICAL ARTICLES

BACKGROUND OF THE INVENTION

I. Field of the Invention

The present invention relates to powder material compacting apparatus and, more particularly, to an improved apparatus for compacting powder material into spherical and similar shapes.

II. Description of the Prior Art

The present invention is concerned with improved tooling for use in powder-compacting presses such as are disclosed in U.S. Pat. Nos. 3,826,599; 3,775,032; 3,730,659; 3,726,622; 3,645,658; 3,574,892; 3,561,056; 3,415,142; 3,344,213; and 3,328,840, all of which are assigned to the same assignee as the present application.

In the powder-compacting presses disclosed in the aforementioned U.S. patents, the articles are compacted and formed in a multi-cavity die forming part of a punch and die set, with the finished articles being automatically ejected from the die cavities, picked up by a vacuum pick-up head, and conveyed into suitable receptacles. A work station positioner assembly, which is part of the press, is mounted angularly movable tranversely over the die plate and carries a powder dispenser, an anvil and the pick-up head. The powder dispenser, which is supplied with powder from a primary powder supply means connected thereto by means of a flexible tubing or the like, is first positioned over the die cavity or cavities which are thus filled with powder as the punches are displaced downwardly so as to draw a predetermined amount of powder into the die cavity or cavities. The dispenser is then removed from above the die cavity or cavities by the subsequent angular motion of the station positioner assembly, and the anvil is, in turn, positioned over the die cavities. The anvil is clamped over the die cavity by means of a pivotable clamp supported above the anvil and actuated in timed relation with the movement of the punches. The anvil is held down with sufficient pressure to permit the compaction of the powder against the anvil as ā result of an upward motion of the punches into the die cavity or cavities. The anvil is then removed from its position over the die cavity or cavities and is replaced by the pick-up head by a further angular motion of the work station positioner transversely across the face of the die plate. The punches are displaced upwardly so as to bring their upper ends in substantial flush alignment with the upper surface of the die plate, such that the finished compacted articles are ejected from the die cavities and picked up by the pick-up head. As the result of a return angular motion of the work station positioner to the initial fill position, the pick-up head is removed from over the die cavity and is disposed over one or, if a plurality of die cavities are employed, a series of discharge apertures arranged in a disposition similar to the arrangement of the die cavities in the die plate, and the finished compacted article or articles are drawn, as by vacuum, through the discharge aperture or apertures into a container or separate containers.

The tooling used in the prior art in compacting powder materials into spherical forms consists of a die having a center bore, and upper and lower punches the faces of which define a spherical cavity. Typically, powder material is charged in a measured quantity into the die bore and hemispherical cavity of the lower punch. The upper punch is then moved through the bore and compacts the powder material in the spherical cavity defined by the end faces of upper and lower punches. It is necessary to make the ends of the walls of the punch members thick enough at the equator of the spherical cavity to prevent distortion or breakage of the walls by the compacting forces. As a result, a portion of the powder material is squeezed in the equatorial space and the end faces of the punches do not make contact with each other. The compacted material then has an equatorial ring or bulge of greater diameter than the diameter of the spherical cavity. The excess material in this ring has to be removed by a tumbling or similar process in order to obtain a spherical article.

The present invention provides an apparatus for producing a compacted spherical article without an equatorial ring or bulge.

SUMMARY OF THE INVENTION

In accordance with the present invention, a spherical mold cavity is defined primarily by an upper punch member and a die with a center bore. These members are brought into engagement prior to the time a compaction stroke is started. The compaction stroke then takes place by reciprocation of the lower punch through the die bore which has a diameter less than the diameter of the spherical cavity.

BRIEF DESCRIPTION OF THE DRAWINGS

FIG. 1 is a broken sectional view of a die with upper and lower punches illustrating the prior art apparatus and method of forming spherical articles from powder material;

FIG. 2 is a view of a spherical article produced by the prior art apparatus and process illustrated in FIG. 1;

FIG. 3 is a broken sectional view of a die and lower punch according to the present invention showing the charging of powder material to the die cavity;

FIG. 4 is a broken sectional view of the apparatus in accordance with the present invention showing the upper punch clamped over the die cavity prior to the powder material compaction step;

FIG. 5 is a broken sectional view similar to FIG. 4 but with the lower punch in the position it occupies after compaction of the material;

FIG. 6 is a broken sectional view similar to FIG. 5 but with the upper punch withdrawn after compaction of the material;

FIG. 7 is a broken sectional view of the die and lower punch with the lower punch in ejection position and pick-up head in place;

DESCRIPTION OF THE PREFERRED EMBODIMENT

Figures 8, 9, 10, 11:
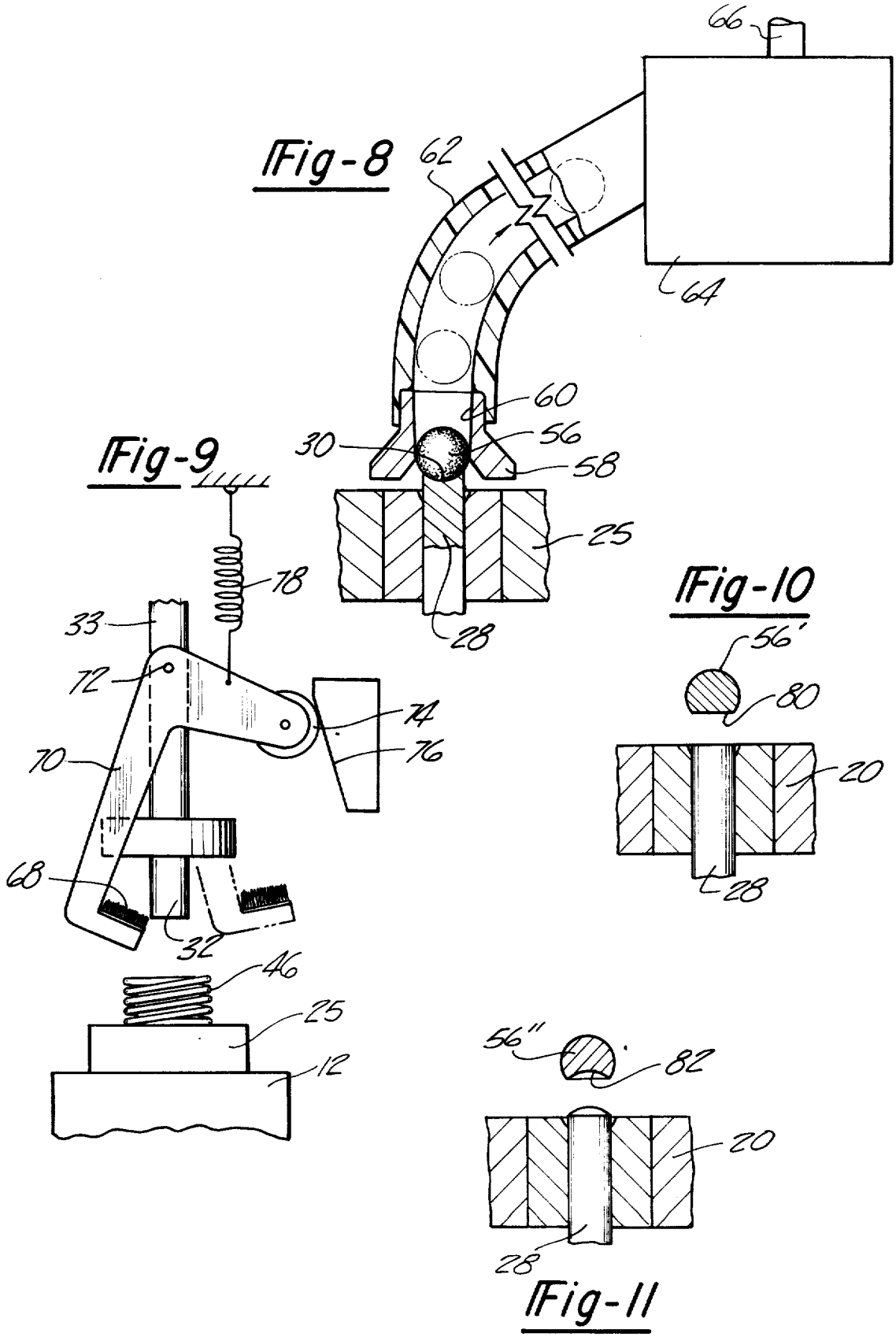
FIG. 8 is a broken sectional view of a vacuum-powered system for collecting spherical articles in a receptacle.
FIG. 9 is a schematic partial elevation view of means for cleaning the end face of the upper punch.
FIGS. 10 and 11 are schematic representations of modifications of lower punch shapes and corresponding articles made thereby.

Referring to FIG. 1, which illustrates the prior art, a die 10 of cylindrical configuration has an axial bore 11. The die 10, which is sometimes referred to as a "die bushing", is normally composed of a very hard material such as cemented tungsten carbide. The die bushing 10 is supported by being press-fitted or otherwise fastened in a bore of a die plate 12 which may be made of carbide but which is normally made of a less costly material than tungsten carbide, such as steel or the like. The die plate is mounted in the table or bed of a press apparatus (not shown).

The die bore 11 accommodates an upper punch 13 and a lower punch 14 which are reciprocally movable therein. The end faces of the punches 13 and 14 define a hemispherical cavity. With the upper punch 13 out of engagement from within the die 10, a measured portion of powder material is poured in the hemispherical cavity of the lower punch 14 and in the bore 11 of the die 10. The upper punch 13 is then moved into the die bore 11 and the lower punch is moved upwardly into compacting engagement with the powder material to compact it into a spherical form as shown at 15. During the compacting stroke, a portion of the powder is caused to project between the flat portions of the end faces of the upper punch 13 and lower punch 14, thus forming an equatorial bulge 16 which prevents engagement of the surfaces of the punches 13 and 14. This equatorial bulge must be factored into the design in order to provide a uniform diameter in a longitudinal direction of the sphere. The product removed from the press is as shown in FIG. 2. It is necessary to remove the bulge 16 by a tumbling or similar process, in order to obtain a generally spherical article.

Referring now to FIGS. 3–7, there is shown, in a schematic manner, an apparatus according to the present invention for molding a generally spherical or partly spherical article without an equatorial bulge. The molding apparatus comprises a die consisting of a die bushing 20 press-fitted, cemented or otherwise disposed in a bore 22 in a die plate 24. The die bushing 20 is preferably made of a hard material, such as tungsten carbide or the like, and the die plate 24 may be made of a tool steel, but is preferably also made of carbide with a highly polished upper surface 25. The die bushing 20 is provided with a longitudinal bore 26 accepting for reciprocation therein a lower punch 28. In the example of structure illustrated, the lower punch 28 has a concave end face 30 shaped substantially as a spherical segment, and the upper end of the die bushing bore 26 is provided with an enlarged portion shaped substantially as a complementary spherical zone, as shown at 31, such that together they define a first half-mold cavity.

The lower punch 28 is reciprocable by means of an appropriate ram 29 forming a part of the press apparatus, not shown, as disclosed in detail in the aforementioned patents, and an upper punch member 32, or counterpart, (FIGS. 4–6) is provided reciprocable towards, and away from, the die plate 24 and die bushing 20 by being mounted on the end of a ram 33 (FIG. 4), reciprocated by appropriate means by the press mechanism, not shown, as disclosed, for example, in aforementioned U.S. Pat. No. 3,826,599. The end face of the upper punch 32 is provided with a hemispherical cavity 34, defining the second half-mold cavity, surrounded by an annular flat surface 36. When reciprocated towards and away from the die plate 24, the upper punch 32 is guided by an anvil member 38, having a lower surface 39 at all times in engagement with the upper surface 25 of the die plate 24, but displaceable from positions away from over the die cavity to a position over the die cavity, the latter position being illustrated at FIGS. 4–6. The upper punch 32 is reciprocable through a vertically disposed bore 40 in the anvil member 38, and has an abutment surface 42 engageable with the top end surface 44 of a coil spring 46, or other biasing means such as superimposed Belleville springs or the like, disposed over a reduced diameter portion 48 of the anvil member 38.

A radial slot 50 is disposed through the wall of the anvil member 38 to provide appropriate clearance for the finished part, when the anvil member 38 is laterally displaced from above the die cavity by means of the operation of the station positioner of the press apparatus as disclosed and explained in detail in the hereinbefore referred-to patents, and more particularly U.S. Pat. Nos. 3,726,622; 3,645,658; 3,574,892; 3,561,056 and 3,145,142.

DESCRIPTION OF OPERATION

In operation, the die cavity is gravity filled with powder material 52 as illustrated at FIG. 3 by means of a powder hopper 54 disposed over the die cavity. During filling of the die cavity with powder material, the lower punch 28 is retracted so as to draw into the die cavity an appropriate amount of powder material 52.

Subsequent to filling of the die cavity with powder material, the powder hopper 54 is laterally displaced, with the result that the edge of the powder hopper 54, in contact with the upper surface 25 of the die plate 24 and the end face 21 of the die bushing 20, wipes the surfaces clean of any powder particles and at the same time levels the charge of powder material 52 evenly flush with the end face 21 of the die bushing 20. The anvil member 38, supported and driven by the station positioner of the press apparatus, is then displaced to its position over the die cavity, and the upper punch 32 is advanced by the ram 33 into the guiding bore 40 of the anvil member 38, thus compressing the spring 46 and forcing firmly the anvil member against the die plate 24 until the annular face 36 of the upper punch 32 engages the end face 21 of the die bushing 20, as represented at FIG. 4.

Although not absolutely necessary for successful operation of the apparatus of the invention, the height of the anvil member 38 and the length of the upper punch 32 are preferably equal, such that, in the position shown at FIG. 4, the punch abutment surface 42 engages the top end surface of the anvil member, therefore applying the anvil member lower face 39 with great pressure against the die plate upper surface 25.

The lower punch 28 is then advanced to the position indicated at FIG. 5 until the recess 30 at the end of the lower punch forms with the spherical zone portion 31 of the die bore wall a complete hemisphere, thus compacting the powder material 52 into a spherical article 56. The press apparatus is adjusted such that the force applied for reciprocating the lower punch 28 is slightly smaller than the force holding the upper punch 32 with its annular face 36 in engagement with the die bushing end face 21. The upper punch 32 is subsequently withdrawn from within the bore 40 in the anvil member 38, as illustrated at FIG. 6, and the anvil member 38 is laterally displaced to a position away from above the die cavity, the slot 50 in the wall of the anvil member providing appropriate clearance for the spherical article 56 during displacement of the anvil member.

A vacuum pickup head 58, also supported by the press apparatus station positioner, is subsequently placed above the die cavity, and the lower punch 28 is advanced upwardly such as to eject the spherical article 56 from the spherical zone wall 31 of the die into the vacuum pickup head 58.

In the structure illustrated at FIG. 7 and in more detail at FIG. 8, the vacuum pickup head 58 has an orifice 60 placed in communication by means of a flexible tubing 62 with a receptacle 64 connected by way of a line 66 to a source of vacuum (not shown). In this manner, the spherical articles 56 ejected from the die cavity are propelled within the tube 62 to the receptacle 64. It will be appreciated that other means of ejecting the finished part, such as mechanical wiper means or vacuum pickup heads provided with a screen to which the finished articles remain adhering until the pickup head is displaced over an appropriate ejection aperture through the die plate communicating with an appropriate receptacle, may also be used in conjunction with the apparatus of the invention as disclosed in the aforementioned patents.

It has been discovered that when forming certain types of powder material into spherical articles, according to the present invention, some powder particles may find their way between the upper punch annular surface 36 and the end face 21 of the die bushing 20. The die bushing end face 21 is kept clean by the wiping action of the powder dispenser edge and, in order to prevent an accumulation and build-up of powder particles on the end annular face 36 of the upper punch 32, means may be provided, as illustrated at FIG. 9, for wiping the annular surface 36 of the punch clean between compacting operations. As illustrated, such wiping operation is effected by means of a vacuum brush 68, having a length corresponding substantially to the diameter of the punch 32, mounted on the end of an arm 70 pivotable about a pivot point 72 disposed on a side of the upper ram 33. A cam follower 74 supported on one side of the arm 70 is engageable with a stationary cam surface 76 when the ram 33 and the punch 32 are reciprocated, so as to move the vacuum brush 68 from the position shown in phantom line at FIG. 9 when the upper punch 32 is advanced, to the position shown in full line when the upper punch 32 is retracted. Appropriate biasing means, such as a spring 78, are provided for urging the arm 70 and the brush 68 in the position shown in phantom line, such that during reciprocation of the upper punch 32, the vacuum brush 68 is caused to traverse the face of the punch, thus removing any powder particles that may remain adhering to the punch face. Other convenient means, such as the rotary brush arrangement disclosed in U.S. Pat. No. 3,328,840, may be used for wiping clean the end face of the upper punch.

It will be readily appreciated that the compacting apparatus of the present invention may be modified to provide compacted articles other than strictly spherical articles. For example, as shown at FIG. 10, by using a lower punch having a flat face an article 56' is obtained of generally spherical shape but provided with a flat face 80 corresponding to the flat end face of the lower punch. With a lower punch 28 having a convex end face, a generally spherical article 56" is obtained, as shown at FIG. 11, having a concave recess 82.

It is to be understood that the example of the present invention as disclosed herein constitutes one preferred form and that other forms might be adopted. For example, the term "spherical" is used to describe the end product, but it is obvious that the invention could be applied to end products which are not spherical in an absolute sense. Consequently, the term "spherical" should not be considered unduly limiting, but should include other shapes within the spirit of the invention and the scope of the appended claims.

What is claimed is:

1. An apparatus for compacting powder material into a spherical solid article, said apparatus comprising a punch and die assembly comprising a die plate, a bore in said die plate, a unitary single piece punch disposed reciprocably in said bore, a concave compacting face on an end of said punch, a progressively enlarged end portion in said bore, said enlarged end portion forming with said compacting face in said punch a first half-mold cavity, a unitary single piece counterpunch overlapping the end portion of said bore and having a flat annular end face engageable with a surface of said die plate surrounding said end portion of said bore and preventing said counterpunch from penetrating into said bore, a second concave half-mold cavity disposed in said counterpunch within said annular end face, said second half-mold cavity being alignable with said bore, supporting and guiding means for said counterpunch disposed above said die plate and having a face in sliding engagement with said die plate, means for reciprocating said punch to a position whereby the face of said punch forms with the enlarged end portion of said bore said first half-mold cavity for compacting said powder material in a molding cavity, means for displacing said punch to a position ejecting said article from said bore upon retraction of said counterpunch a distance away from said die plate, and a slot in said supporting and guiding means for clearing said article when ejected from said bore.

2. The apparatus of claim 1 wherein said bore is in a die bushing disposed in said die plate and the flat annular end face of said counterpunch is engageable with an end of said bushing.

3. The apparatus of claim 2 further comprising means for applying a clamping force to said counterpunch in engagement with the end of said bushing and abutment means on said counterpunch for engagement with said supporting and guide means for transmitting said clamping force to said supporting and guide means.

4. The apparatus of claim 3 wherein said clamping force is transmitted by said abutment means to said supporting and guiding means by spring bias means.

5. The apparatus of claim 1 further comprising means cleaning said counterpunch end face from powder particles when said end face is disengaged.

6. The apparatus of claim 1 wherein said punch powder compacting concave face forms a spherical segment, said bore enlarged end portion forms a spherical zone, said spherical segment and zone defining a hemisphere, and said second half-mold cavity in said is a hemisphere.

* * * * *